US008298125B2

(12) United States Patent
Colledge et al.

(10) Patent No.: US 8,298,125 B2
(45) Date of Patent: Oct. 30, 2012

(54) WEIGHTLIFTING DEVICE WITH MECHANISM FOR DISENGAGING WEIGHT PLATES

(75) Inventors: Matthew Colledge, Logan, UT (US); Michael Olson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

(21) Appl. No.: 12/847,813

(22) Filed: Jul. 30, 2010

(65) Prior Publication Data

US 2011/0045956 A1 Feb. 24, 2011

Related U.S. Application Data

(60) Provisional application No. 61/230,673, filed on Jul. 31, 2009.

(51) Int. Cl.
*A63B 21/072* (2006.01)

(52) U.S. Cl. ..... 482/107; 482/108

(58) Field of Classification Search ..... 482/98, 482/106–109, 92–94
See application file for complete search history.

(56) References Cited

U.S. PATENT DOCUMENTS

| | | | | |
|---|---|---|---|---|
| 1,422,888 | A | 7/1922 | Reeves et al. | |
| 1,672,944 | A | 6/1928 | Jowett | |
| 1,917,566 | A | 7/1933 | Wood | |
| 3,758,109 | A | 9/1973 | Bender | |
| D244,628 | S | 6/1977 | Wright | |
| 4,029,312 | A | 6/1977 | Wright | |
| 4,076,236 | A | 2/1978 | Ionel | |
| 4,529,197 | A * | 7/1985 | Gogarty | 482/107 |
| 4,529,198 | A | 7/1985 | Hettick, Jr. | |
| 4,566,690 | A | 1/1986 | Schook | |
| 4,575,074 | A | 3/1986 | Damratoski | |
| 4,627,618 | A | 12/1986 | Schwartz | |
| 4,651,988 | A | 3/1987 | Sobel | |
| 4,743,017 | A | 5/1988 | Jaeger | |
| 4,768,780 | A | 9/1988 | Hayes | |

(Continued)

FOREIGN PATENT DOCUMENTS

CN 201912695 U * 8/2011

(Continued)

OTHER PUBLICATIONS

PowerBlock, *The World's Only Selectorized Dumbbell, 1995 IntellBell, Inc.*, 1 page.

(Continued)

*Primary Examiner* — Loan Thanh
*Assistant Examiner* — Victor K Hwang
(74) *Attorney, Agent, or Firm* — ICON Health & Fitness, Inc.

(57) ABSTRACT

Exercise weight bars are disclosed that provide an easy and efficient way for a user to quickly remove, add, and secure weight plates to the exercise weight bars. The exercise weight bars provide weight locks that may remain attached to the exercise weight bar during the interchange of weight plates. The exercise weight bars can accept one or more weight plates on the ends thereof. The weight locks includes extension members that engage the weight plates when the weight locks are rotated to a locked position, thereby securing the weight plates to the exercise weight bar. When the weight locks are rotated to an unlocked position, the extension members are retracted to disengage the weight plates, thereby allowing the weight plates to be removed from the exercise weight bar.

20 Claims, 8 Drawing Sheets

U.S. PATENT DOCUMENTS

| | | | | |
|---|---|---|---|---|
| 4,822,034 | A | 4/1989 | Shields | |
| 4,822,035 | A | 4/1989 | Jennings et al. | |
| 4,880,229 | A | 11/1989 | Broussard | |
| 4,900,016 | A | 2/1990 | Caruthers | |
| D307,168 | S | 4/1990 | Vodhanel | |
| 4,913,422 | A | 4/1990 | Elmore et al. | |
| 4,948,123 | A | 8/1990 | Schook | |
| D315,003 | S | 2/1991 | Huang | |
| 5,040,787 | A | 8/1991 | Brotman | |
| D321,230 | S | 10/1991 | Leonesio | |
| 5,123,885 | A | 6/1992 | Shields | |
| 5,131,898 | A | 7/1992 | Panagos | |
| D359,778 | S | 6/1995 | Towley, III et al. | |
| 5,637,064 | A | 6/1997 | Olson et al. | |
| 5,769,762 | A | 6/1998 | Towley, III et al. | |
| 5,779,604 | A | 7/1998 | Towley, III et al. | |
| 5,839,997 | A | 11/1998 | Roth et al. | |
| 5,876,313 | A | 3/1999 | Krull | |
| 5,935,048 | A | 8/1999 | Krull | |
| 5,944,642 | A | 8/1999 | Krull | |
| 5,971,899 | A | 10/1999 | Towley, III et al. | |
| 6,033,350 | A | 3/2000 | Krull | |
| 6,083,144 | A | 7/2000 | Towley, III et al. | |
| 6,099,442 | A | 8/2000 | Krull | |
| 6,149,558 | A | 11/2000 | Chen | |
| 6,183,401 | B1 | 2/2001 | Krull | |
| 6,186,927 | B1 | 2/2001 | Krull | |
| 6,186,928 | B1 | 2/2001 | Chen | |
| 6,196,952 | B1 | 3/2001 | Chen | |
| 6,228,003 | B1 | 5/2001 | Hald et al. | |
| 6,261,022 | B1 | 7/2001 | Dalebout et al. | |
| 6,322,481 | B1 | 11/2001 | Krull | |
| 6,350,221 | B1 | 2/2002 | Krull | |
| 6,387,018 | B1 | 5/2002 | Krull | |
| 6,387,019 | B1 | 5/2002 | Krull | |
| 6,402,666 | B2 | 6/2002 | Krull | |
| 6,416,446 | B1 | 7/2002 | Krull | |
| 6,422,979 | B1 | 7/2002 | Krull | |
| 6,436,013 | B1 | 8/2002 | Krull | |
| 6,447,432 | B1 | 9/2002 | Krull | |
| 6,500,101 | B1 | 12/2002 | Chen | |
| 6,540,650 | B1 | 4/2003 | Krull | |
| 6,629,910 | B1 | 10/2003 | Krull | |
| 6,666,800 | B2 | 12/2003 | Krull | |
| 6,669,606 | B2 | 12/2003 | Krull | |
| 6,679,816 | B1 | 1/2004 | Krull | |
| 6,719,674 | B2 | 4/2004 | Krull | |
| 6,733,424 | B2 | 5/2004 | Krull | |
| 6,746,381 | B2 | 6/2004 | Krull | |
| 6,749,547 | B2 | 6/2004 | Krull | |
| D500,820 | S | 1/2005 | Krull | |
| 6,855,097 | B2 | 2/2005 | Krull | |
| 6,872,173 | B2 | 3/2005 | Krull | |
| 6,896,645 | B1 | 5/2005 | Krull | |
| 6,899,661 | B1 | 5/2005 | Krull | |
| 6,902,516 | B2 | 6/2005 | Krull | |
| 6,971,974 | B2 | 12/2005 | Bowman | |
| 6,974,405 | B2 | 12/2005 | Krull | |
| 6,997,856 | B1 | 2/2006 | Krull | |
| 7,029,425 | B2 | 4/2006 | Krull | |
| 7,048,677 | B2 | 5/2006 | Mackert et al. | |
| 7,066,867 | B2 | 6/2006 | Krull | |
| 7,077,791 | B2 | 7/2006 | Krull | |
| 7,087,000 | B1 * | 8/2006 | Walker | 482/107 |
| 7,238,147 | B2 | 7/2007 | Mills | |
| 7,261,678 | B2 | 8/2007 | Crawford et al. | |
| 7,367,927 | B2 | 5/2008 | Krull | |
| 7,429,235 | B2 * | 9/2008 | Lin | 482/108 |
| 7,534,199 | B2 | 5/2009 | Krull | |
| 7,563,208 | B1 | 7/2009 | Chen | |
| 7,578,772 | B2 * | 8/2009 | Lippitt | 482/108 |
| 7,625,322 | B1 * | 12/2009 | Krull | 482/107 |
| 7,887,469 | B1 * | 2/2011 | Chen | 482/108 |
| 2009/0186748 | A1 | 7/2009 | Golesh et al. | |

FOREIGN PATENT DOCUMENTS

| | | | |
|---|---|---|---|
| CN | 201930452 | U * | 8/2011 |
| FR | 637.365 | | 4/1928 |
| FR | 2 452 296 | | 10/1980 |
| KR | 2011135545 | A * | 12/2011 |
| SU | 1258447 | | 9/1985 |
| SU | 1367987 | | 1/1988 |
| SU | 1659073 | | 6/1991 |
| SU | 1687271 | | 10/1991 |

OTHER PUBLICATIONS

Power Training Bar User's Guide, copyright 2009, Icon Health & Fitness, Inc., 2 pages.

PINK Fitness Workout Kit, retrieved on Jul. 31, 2009 from www.weiderfitness.com/webapp/wds/stores/servlet/Product__-1__14801__17102__48002__149803, 5 pages.

Adventures in Fitness, retrieved on Jul. 22, 2010 from http://breagettingfit.wordpress.com/category/pink-fitness/, 9 pages.

Google search results for "pink fitness", retrieved on Jul. 22, 2010, 2 pages.

P.I.N.K. Fitness Highlight Video page, retrieved on Jul. 22, 2010 from http://www.youtube.com/watch?v—NxzRPS1ZUow, available on information and belief at least as early as Feb. 17, 2009, 2 page.

P.I.N.K. Fitness website, http://www.pinkfitness.com, retrieved on Jul. 30, 2009, 8 pages.

P.I.N.K. Fitness website "Terms of Use", http://www.pinkfitness.com/terms/, retrieved on Jul. 30, 2009, 4 pages.

P.I.N.K. Fitness website "Shopping Cart", http://shop.pinkfitness.com, retrieved on Jul. 30, 2009, 2 pages.

SelectaBell, retrieved on Mar. 30, 2004 from www.sellectabell.com, 1 page.

Iron Master Quick Change Adjustable Dumbbells, retrieved on May 3, 2004 from www.thetreadmillstore.com/iron.htm, 3 pages.

ProBell—Sculpt Your Body, Indulge Your Spirit, retrieved on May 3, 2004 from.www.probell.com, 1 page.

Powerblock ProBlock, retrieved on May 3, 2004 from www.proactive-health.co.uk/powerblock.problock.html, 1 page.

Quantum Fitness Turbobell Dumbbell System, retrieved on May 7, 2004 from www.quantumfitness.com/home/turbobell.shtml, 2 pages.

Stamina 25lb. Versa-Bell Adjustable Dumbbell System, retrieved on May 3, 2004 from www.egymequipment.com/st25veaddusy.html, 2 pages.

Ride with the Bike Shack, *What's Happening*, retrieved on May 7, 2004 from www.thebikeshack.com/WhatsHappening.htm, 4 pages.

TechnoScout Adjustable Dumbbell, retrieved on Apr. 29, 2004 from www.technoscout.com, 1 page.

TurboBell Shift-and-Lift Dumbbell Systems, retrieved on Mar. 17, 2004 from www.turbobell.com, 2 pages.

Quantum Fitness Turbobell Dumbbell System, retrieved on Mar. 30, 2004 from www.quantumfitness.com/home__products/turbobell.shtml, 2 pages.

TurboFit Free Weight Systems, retrieved on Mar. 30, 2004 from www.turbofit.com, 2 pages.

TurboFit, *TurboFit Enters the Fitness Market with a Fresh Approach to Dumbbells*, retrieved on Mar. 30, 2004 from www.turbofit.com/company/index.cfm, 2 pages.

TurboFit, *MoreWeight, Less Wait*, retrieved on Mar. 30, 2004 from www.turbofit.com/dealers/index.cfm, 2 pages.

TurboFit, *TurboFit Blasts Into the Fitness Market with Revolutionary Free Weight Systems that are, Easy to Use, Easy to Move, Easy to Store, Easy to Buy!*, retrieved on Mar. 30, 2004 from www.turbofit.com/press/release__7-29-03.cfm, 2 pages.

* cited by examiner

WEIGHTLIFTING DEVICE WITH MECHANISM FOR DISENGAGING WEIGHT PLATES

CROSS-REFERENCE TO RELATED APPLICATIONS

This application claims priority to and the benefit of U.S. Provisional Patent Application No. 61/230,673, filed Jul. 31, 2009, entitled WEIGHTLIFTING DEVICE WITH MECHANISM FOR DESENGAGING WEIGHT PLATES, which is incorporated herein by reference in its entirety.

BACKGROUND OF THE INVENTION

1. The Field of the Invention

The present disclosure generally concerns weightlifting exercise equipment. More specifically, the present disclosure concerns exercise weight bars with removable weight plates.

2. The Relevant Technology

Exercise weight bars including dumbbells and barbells are well known in the art and are widely used as part of weight-based exercise training. Many traditional exercise weight bars are fixed-weight exercise bars requiring the availability of multiple exercise weight bars in a variety of weights. Some exercise weight bars allow a user to choose the amount of weight for the bar by allowing a user to place weights of various magnitudes on the bar. In this way, a user may use a single exercise weight bar for exercising with a variety of weights.

Some exercise weight bars have no way of securing weights on the bar. Other exercise weight bars have caps or other weight securing devices that may be placed on the exercise weight bar after the user has placed the desired weights on the bar. However, the securing devices are often small, cumbersome, and may be lost. As a result, a user may choose to exercise without securing the weights on the exercise weight bar if the securing devices are too difficult to manipulate or cannot be found after being separated from the exercise weight bar. Improved weight securing devices are thus needed.

BRIEF SUMMARY OF THE INVENTION

Exercise weight bars of the present invention provide an easy and efficient way for a user to quickly remove, add, or secure weight plates to an exercise weight bar. Additionally, the disclosed exercise weight bars provide weight securing devices that may remain attached to the exercise weight bar during the interchange of weight plates.

In one exemplary embodiment, an exercise weight bar is adapted to have weight plates selectively secured thereto for exercise. The exercise weight bar includes a handle having a first end and a second end. The exercise weight bar also includes a first weight plate mount disposed at the first end of the handle and a second weight plate mount disposed at the second end of the handle. Each of the first and second weight plate mounts includes at least one slot formed therein and a rotatable weight lock. The rotatable weight lock includes at least one extension member that corresponds with the at least one slot. The rotatable weight lock is rotatable between a locked position and an unlocked position. At least one extension member extends through the at least one slot when the rotatable weight lock is in the locked position and the at least one extension member does not extend through the at least one slot when the rotatable weight lock is in the unlocked position.

The first and second weight plate mounts described above may each have a generally triangular configuration with three side walls. The rotatable weight lock may also include a handle that facilitates rotation of the rotatable weight lock between the unlocked and locked positions.

The handle of the exercise weight bar includes a grip adapted to be grasped by a user during use of the exercise weight bar. Each of the first and second weight plate mounts can also include a hard stop that prevents the weight plates from sliding onto the grip.

Each of the first and second weight plate mounts described above may include a housing. In some embodiments, the at least one slot is formed in the housings. The rotatable weight lock can be at least partially positioned within the housing such that rotation of the rotatable weight lock between the unlocked and locked positions enables the at least one extension member to extend out of the housing through the at least one slot or be retracted within the housing through the at least one slot.

In another embodiment, an exercise weight bar is configured to have weight plates quickly and efficiently secured thereto, forming an exercise weight bar assembly. The exercise weight bar includes a handle having a first end, a second end, the handle having a grip. The exercise weight bar also includes a housing linked to the first end of the handle, the housing having a first end, a second end positioned further away from the grip than the first end, and a plurality of slots positioned between the first and second ends of the housing. The housing can be adapted to have one or more weight plates positioned thereon. The exercise weight bar can further include a hard stop disposed at the first end of the housing to prevent the weight plates from moving onto the grip, as well as a rotatable weight lock positioned at least partially within the housing. The rotatable weight lock can be adapted for rotation between a locked position and an unlocked position to selectively engage or disengage weight plates positioned on the housing. The rotatable weight lock can include a plurality of extension members configured to extend through the plurality of slots of the housing to selectively engage the weight plates when the rotatable weight lock is rotated to the locked position. The plurality of extension members can also be configured to be refracted through the plurality of slots into the housing and to disengage the weight plates when the rotatable weight lock is rotated to the unlocked position.

The housing of the exercise weight bar can be coupled to the first end of the handle. The housing described above can have a cross-sectional shape that generally corresponds to the cross-sectional shape of an aperture in a weight plate that is received on the housing. The exercise weight bar can further include a housing, a hard stop, and a weight lock positioned at the second end of the bar.

The plurality of slots can include includes two or more slots that are longitudinally spaced apart between the first and second ends of the housing. In some embodiments, the plurality of slots extend generally parallel to the circumference of the bar. Rotation of the rotatable weight lock between the unlocked and lock positions can be generally about the axis of the exercise weight bar.

The plurality of extension members can include two or more longitudinally spaced apart extension members, wherein the two or more longitudinally spaced apart extension members correspond to the two or more slots such that the two or more longitudinally spaced apart extension members extend out of the two or more slots when the rotatable weight lock is rotated to the locked position.

In still a further embodiment of the present invention, a weightlifting device includes a handle having a first end and a second end; a plurality of weight plates that correspond to the first end and a plurality of weight plates that correspond to the second end; and a first latching mechanism associated with the first end and a second latching mechanism associated with the second end. Each of the first and second latching mechanisms can include a hollow portion having a wall and being configured to receive one or more of the plurality of weight plates and a plurality of slots formed within the wall. Additionally, each of the first and second latching mechanisms can include a rotatable locking mechanism that rotates within the hollow portion, the rotatable locking mechanism having a locked position and an unlocked position. The rotatable locking mechanism extends through the plurality of slots and engages one or more of the plurality of weight plates when in the locked position. The rotatable locking mechanism does not extend through the plurality of slots when in the unlocked position.

The plurality of slots described in the previous embodiment may be longitudinally spaced apart along the length of the hollow portion wall such that a weight plate of the plurality of weight plates can be positioned between the plurality of slots. The rotatable locking mechanism can include a handle to enable a user to rotate the rotatable locking mechanism between the unlocked and locked positions. The rotatable locking mechanism handle can extend past a cross-sectional profile of the hollow portion when the locking mechanism is in the locked position.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Exercise weight bars are herein disclosed that provide an easy and efficient way for a user to quickly remove and add weight plates to the exercise weight bars. Additionally, the disclosed exercise weight bars provide weight securing devices that remain attached to the exercise weight bars during the interchange of weight plates.

In one embodiment, an exercise weight bar of the present invention accepts one or more weight plates. The exercise weight bar includes a handle section for a user to grip during exercise and hard stops that prevent weight plates from moving into the handle section. The ends of the exercise weight bar, on which weight plates are placed, include hollow portions having a wall with slots therein. The slots are spaced apart so that weight plates can be selectively positioned therebetween. A weight lock is located partially inside the hollow portion and includes extension members that correspond to the slots. The weight lock is rotatable into an unlocked position in which the extension members remain inside the hollow portion so that weight plates may be positioned on the exercise weight bar. After weight plates are placed on the exercise weight bar, the weight lock may be rotated into a locked position in which the extension members protrude out of the slots and prevent the weight plates from sliding along or off the exercise weight bar.

Figure 1A:
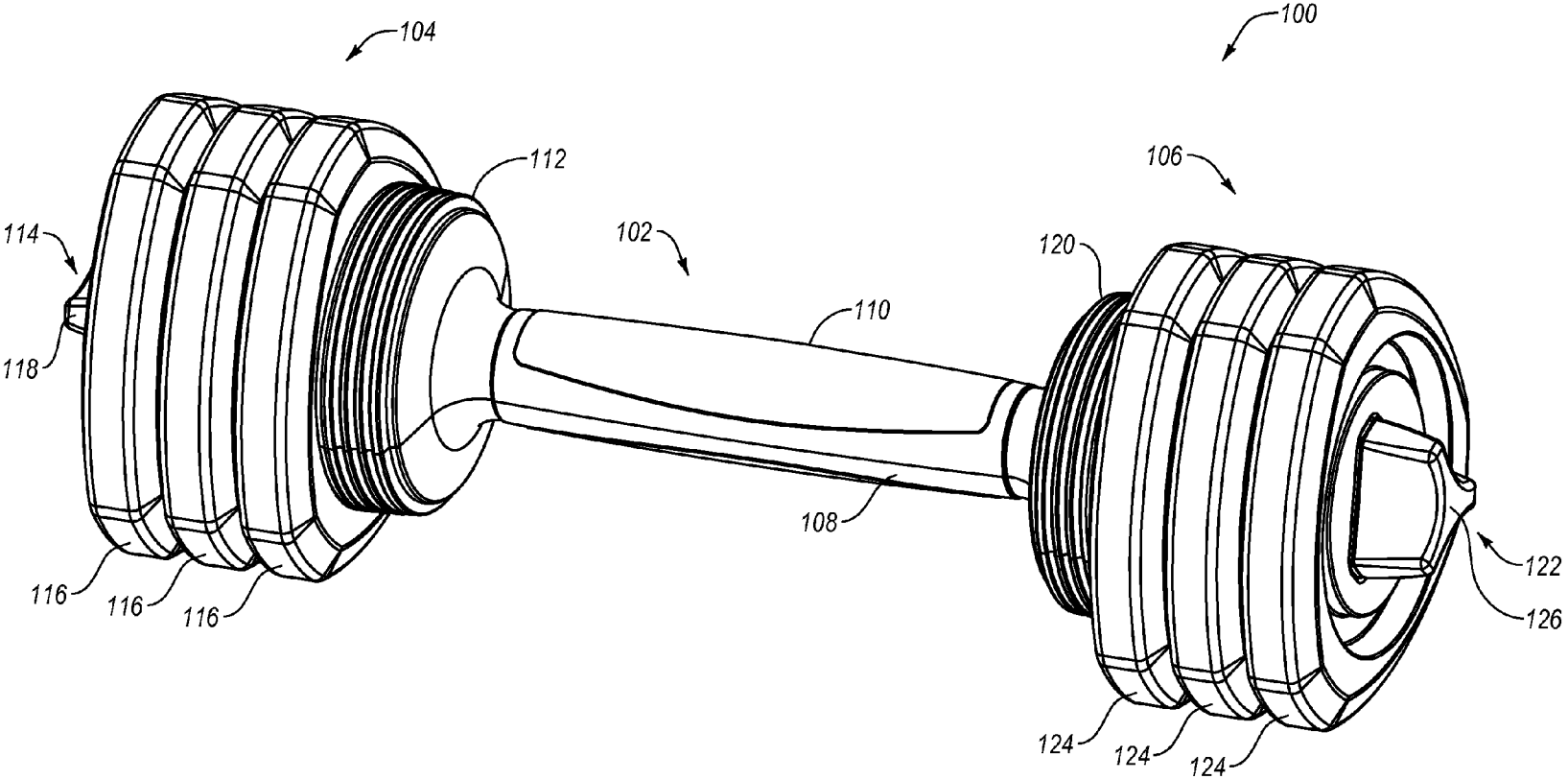
FIG. 1A illustrates an exercise weight bar assembly according to one exemplary embodiment of the present invention.
Figure 1B:
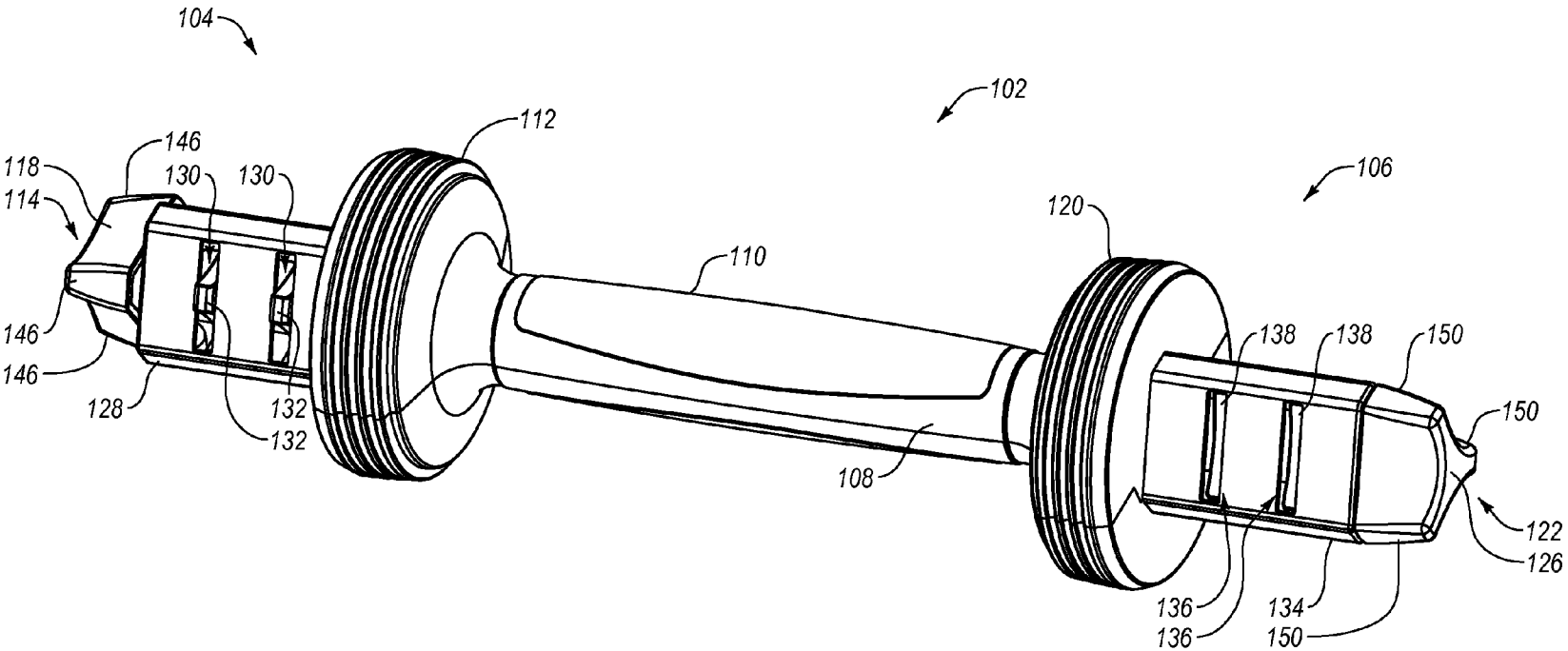
FIG. 1B illustrates an exercise weight bar from the exercise weight bar assembly of FIG. 1 with the weight plates removed and showing one weight lock in a locked position and another weight lock in an unlocked position.

FIGS. 1A-1B show one embodiment of an exercise weight bar assembly 100. Exercise weight bar assembly 100 includes an exercise weight bar 102 having a first weight plate mount 104, a second weight plate mount 106, and a handle 108 linked to first and second weight plate mounts 104, 106. In the illustrated embodiment, handle 108 of exercise weight bar 102 is sized to be gripped in one hand of a user. At least of portion of exercise weight bar 102 is typically formed of a rigid material such as metal or plastic. Handle 108 also includes a grip 110. Grip 110 can include a textured or non-slip surface or material to provide an improved grip during exercise.

First weight plate mount 104 includes a hard stop 112 and a weight lock 114. Weight plates 116 are mounted on first weight plate mount 104. Weight lock 114 includes a handle 118 that is configured to be gripped by a user so that a user may rotate weight lock 114. As will be discussed in greater detail below in connection with FIGS. 1B-2C, rotation of weight lock 114 allows for weight plates 116 to be selectively placed and secured on first weight plate mount 104 or selectively removed from first weight plate mount 104 of exercise weight bar 102. Hard stop 112 is located between handle 118 of weight lock 114 and handle 108. Hard stop 112 prevents weight plates 116 from sliding along exercise weight bar 102 onto handle 108. Thus, hard stop 112 prevents weight plates 116 from interfering with a user's hand when the user is exercising with exercise weight bar assembly 100.

Second weight plate mount 106 of exercise weight bar 102 is configured identically or similarly to first weight plate mount 104. More particularly, second weight plate mount 106 includes a hard stop 120 and a weight lock 122. Weight plates 124 are mounted on second weight plate mount 106. Weight lock 122 includes a handle 126 that is configured to be gripped by a user so that a user may rotate weight lock 122. Like weight lock 114, the rotation of weight lock 122 allows for weight plates 124 to be selectively placed and secured on second end 106 or selectively removed from second end 106 of exercise weight bar 102. The structural and functional characteristics of weight lock 114 will be discussed in greater detail below in connection with FIGS. 1B-2C. Hard stop 120 is located between handle 126 of weight lock 122 and handle 108. Hard stop 120 prevents weight plates 124 from sliding along exercise weight bar 102 onto handle 108. Like hard stop 112, hard stop 120 prevents weight plates 124 from interfering with a user's hand when the user is exercising with exercise weight bar assembly 100.

As shown and described, exercise weight bar 102 is configured to be gripped by one hand of a user. That is, exercise weight bar 102 is configured as a dumbbell with handle 108 being generally sized in length and circumference to be held by one hand. Other embodiments of exercise weight bars according to the present invention may be sized for two-handed exercise, such as bench press exercises. As will be discussed below in connection with FIGS. 4 and 5, for example, an exercise weight bar assembly to the present invention may be configured as a barbell with a handle that is sized to be held by two hands. In other embodiments, exercise weight bars may be bent or curved to accommodate various weight training exercises. Further, an exercise weight bar according to the present invention may be configured to receive any number of weight plates.

It will be understood by one of ordinary skill in the art that the components of the exercise weight bars of the present invention may be formed from any suitable materials. For instance, the components of the exercise weight bars may be formed of metal, plastic, ceramic, rubber, foams, composite materials, or combinations thereof. Likewise, the components may be formed by any suitable manufacturing processes. Such manufacturing processes may include, but are not limited to, casting, forging, extruding, molding, including blow molding and injection molding, or combinations thereof.

With specific attention to FIG. 1B, exercise weight bar 102 is illustrated without weight plates 116 and 124 positioned on first and second weight plate mounts 104 and 106, respectively. With weight plates 116 and 124 removed, additional features and details of first and second weight plate mounts 104 and 106 can be seen. In addition to hard stop 112 and weight lock 114, first weight plate mount 104 also includes a housing 128 that is adapted to support weight plates 116 thereon. Housing 128 is formed of a wall that defines a hollow interior portion. Housing 128 includes a plurality of slots 130 formed therein. For instance, slots 130 may be formed or cut into the wall of housing 128. In the illustrated embodiment, housing 128 has a generally triangular cross-sectional shape with slots 130 on each side of housing 128. Additionally, slots 130 on each side of housing 128 are longitudinally spaced apart from one another. As will be discussed below, longitudinally spacing apart slots 130 facilitates the selective placement and securing of weight plates 116 on first weight plate mount 104.

Housing 128 may be an integral part of exercise weight bar 102 or may be formed separately from the handle and/or the hard stop and later joined or coupled thereto. For instance, an exercise weight bar of the present invention may be formed with a hollow end that has slots 130 formed or cut therein. Alternatively, an exercise weight bar of the present invention may comprise a rod, and housing 128 with slots 130 formed or cut therein may be molded or otherwise formed as a discrete, separate piece. In such an embodiment, housing 128 could then be mounted, attached, coupled, or otherwise joined to the rod of the exercise weight bar. For instance, housing 128 could be formed with a hollow interior portion that is sized to receive the end of the rod therein. Housing 128 could be coupled onto the end of the rod by any suitable means, including adhesives, screws, pins, clips, clamps, and the like. Thus, a housing and/or a hard stop could be directly coupled (e.g., via fusing, molding, welding, adhesives, mechanical fasteners, etc.) to one another and/or to a handle. Alternatively, a housing and/or a hard stop could be linked to one another and/or to a handle via a rod, in a manner like that shown in FIG. 5.

Figure 2A:
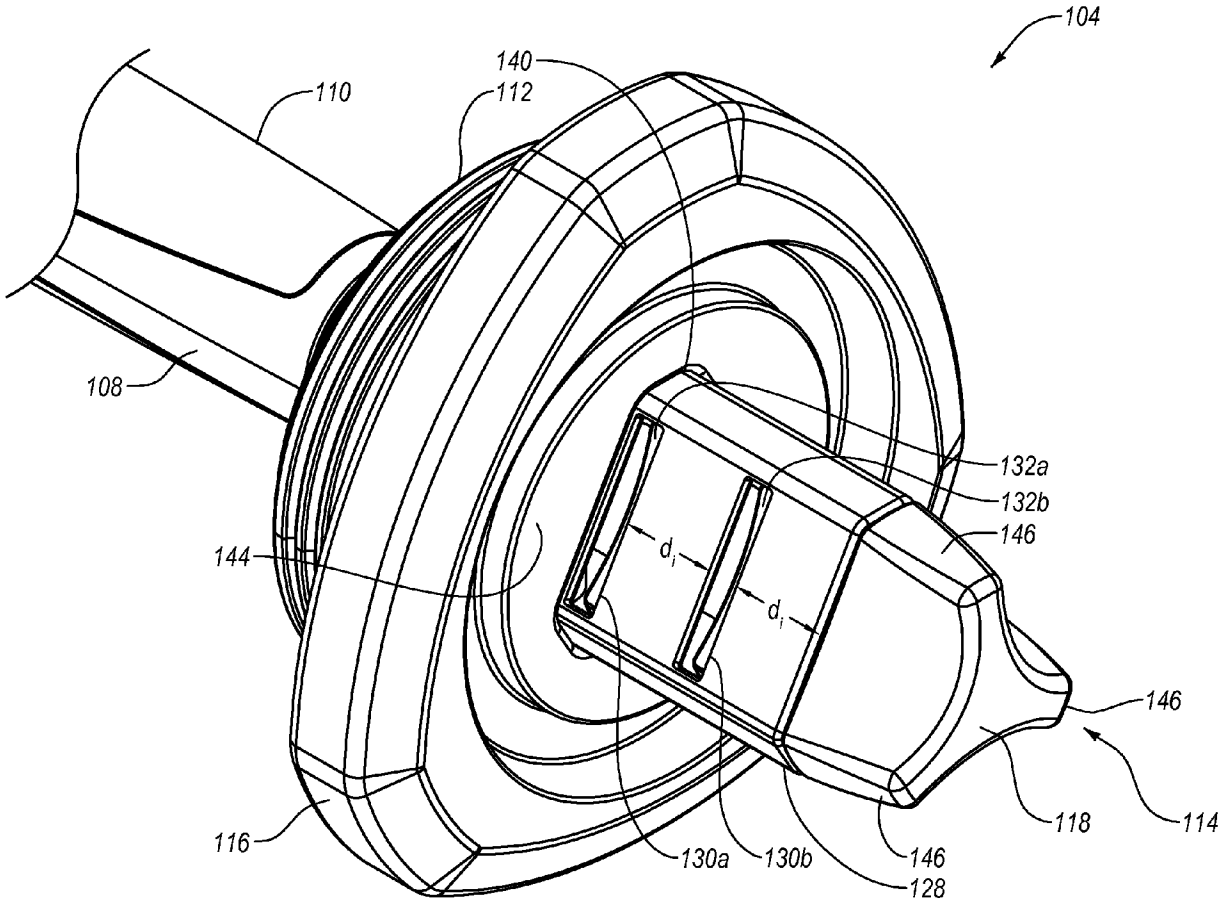
FIG. 2A illustrates a close up view of an end of the exercise weight bar of FIGS. 1A-1B, in which the weight lock is in a unlocked position.
Figure 2B:
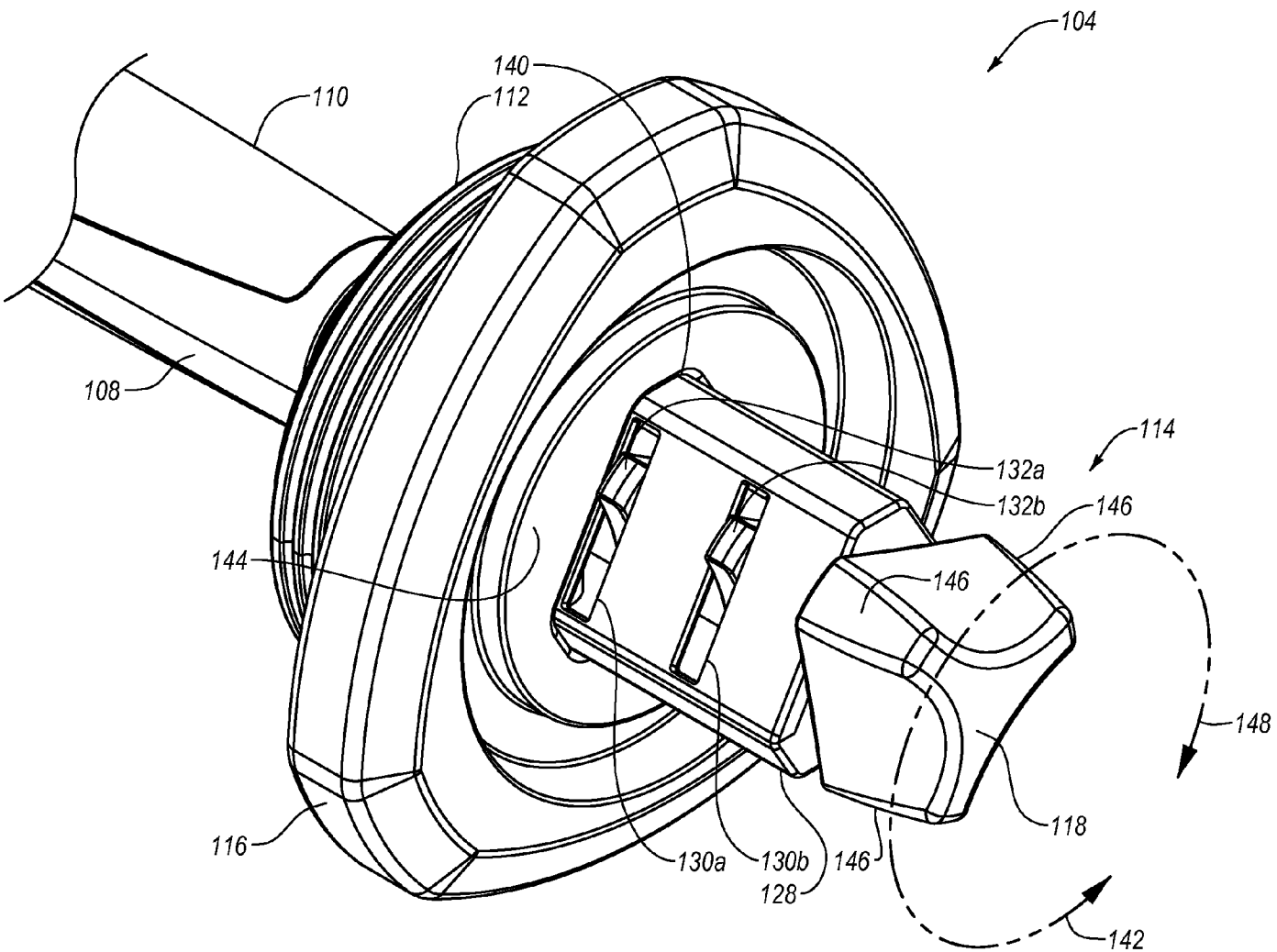
FIG. 2B illustrates the exercise weight bar end shown in FIG. 2A, with the weight lock shown at an intermediate positioned between the unlocked position and the locked position.
Figure 2C:
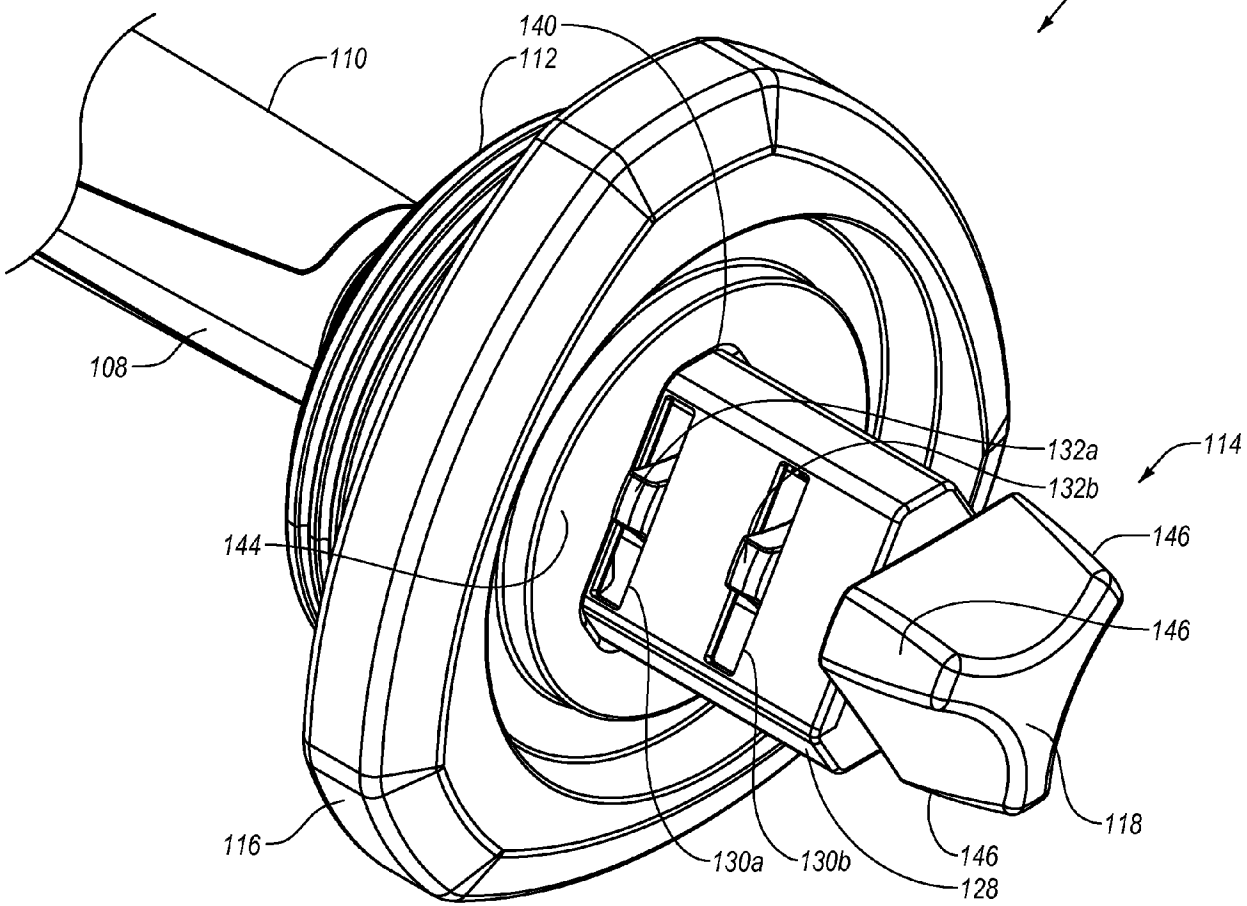
FIG. 2C illustrates the exercise weight bar end shown in FIGS. 2A and 2B, with the weight lock shown in the locked position.

As also illustrated in FIG. 1B, weight lock 114 is partially positioned within housing 128 and includes a plurality of extension members 132. Extension members 132 are associated or correspond with slots 130 and are operatively associated with handle 118 of weight lock 114. As handle 118 is rotated, extension members 132 are either retracted into housing 128 through slots 130 or are extended out of housing 128 through slots 130. Extension members 132 are illustrated in FIG. 1B as extending out of slots 130. When extension members 132 extend out of slots 130, extension members 132 and weight lock 114 are in a locked position. In other words, when extension members 132 extend out of slots 130, extension members 132 are configured to lock or secure weight plates 116 on first weight plate mount 104, as shown in FIG. 2C. In contrast, when extension members 132 are retracted into housing 128 (e.g., extension members 132 do not extend out of slots 130, as shown in FIG. 2A), extension members 132 and weight lock 114 are in an unlocked position. In other words, when extension members 132 do not extend out of slots 130, extension members 132 are configured to allow weight plates 116 to be placed on or removed from first weight plate mount 104.

The various components of first weight plate mount 104 may be collectively referred to as a weight plate mount, a weight plate interchange system, or a latching mechanism. That is, hard stop 122, housing 128 with slots 130, and weight lock 114 can be considered a weight plate mount, a weight plate interchange system, or a latching mechanism. In some embodiments, weight plate mounts, weight plate interchange systems, or latching mechanisms may not include all of the referenced components. For instance, in some embodiments, a weight plate mount, weight plate interchange system, or latching mechanism may not include a hard stop.

Like first weight plate mount 104, second weight plate mount 106 also includes a housing 134 in addition to hard stop 120 and weight lock 122. Housing 134 has a similar or identical structure and performs similar or identical functions as housing 128. For instance, housing 134 is adapted to support weight plates 124 thereon. Additionally, housing 134 is formed of a wall that defines a hollow interior portion and has a plurality of slots 136 formed therein. Like housing 128, housing 134 can have a generally triangular cross-sectional shape with slots 136 formed on each side thereof, as well as slots longitudinally spaced apart on each side to facilitate the selective placement and securing of weight plates 124 on second weight plate mount 106. Also like housing 128, housing 134 can be formed as an integral piece of exercise weight bar 102 or can be formed as a separate piece and later coupled to handle 108 and/or hard stop 120.

As also illustrated in FIG. 1B, weight lock 122 includes a plurality of extension members 138. Extension members 138 are associated or correspond with slots 136 and are operatively associated with handle 126 of weight lock 122. As handle 126 is rotated, extension members 138 are either retracted into housing 134 through slots 136 or are extended out of housing 134 through slots 136. Extension members 138 are illustrated in FIG. 1B as being refracted within housing 134 (e.g., not extending out of housing 134 through slots 136). Like extension members 132 and weight lock 114, when extension members 138 extend out of slots 136, extension members 138 and weight lock 122 are in a locked position so as to be able to lock or secure weight plates 124 on second weight plate mount 106. In contrast, when extension members 138 are retracted into housing 134 as shown in FIG. 1B, extension members 138 and weight lock 122 are in an unlocked position that allows weight plates 124 to be placed on or removed from second weight plate mount 106.

Weight locks 114 and 122 can be selectively rotated between locked and unlocked positions to allow for weight plates 116 and 124, respectively, to be selectively placed and secured on exercise weight bar 102 or removed from exercise weight bar 102. FIGS. 2A-2C illustrate the selective rotation of a weight lock between an unlocked and a locked position. While FIGS. 2A-2C and the following description illustrate and describe the transition between an unlocked position and a locked position of a weight lock using weight lock 114 of first weight plate mount 104 as an example, the following description is germane to weight lock 122 of second weight plate mount 106. That is, weight lock 122 can be transitioned between an unlocked and a locked position in a manner similar to the following description relating to weight lock 114.

As noted above, first weight plate mount 104 of exercise weight bar 102 includes hard stop 112, housing 128 with slots 130 therein, and weight lock 114 for selectively receiving and securing one or more weight plates 116 thereon. Hard stop 112 is secured in place so that is does not move along the length of exercise weight bar 102. With hard stop 112 secured in place, hard stop 112 prevents weight plate 116 from sliding onto handle 108. Hard stop 112 thereby prevents weight plates 116 from interfering with a user's hand while grasping handle 108.

Housing 128 is hollow or has a hollow interior portion that allows for at least a portion of weight lock 114 to be inserted into housing 128. In particular, the portion of weight lock 114 that includes extension members 132 can be inserted or otherwise positioned within housing 128. When positioned within housing 128 as shown, weight lock 114 can rotate therein to cause extension members 132 to extend or be retracted through slots 130, as described below. As noted above, slots 130 and extension members 132 are arranged to correspond with one another to allow extension members 132 to be selectively extended or retracted through slots 130. More specifically, each extension member 132 corresponds to at least one slot 130. For the sake of clarification in the following description relating to FIGS. 2A-2C, slots 130 and extension members 132 have been identified as slots 130*a* and 130*b* and extension members 132*a* and 132*b*, respectively. It will be understood, that the present invention may be practiced with fewer or more than two slots and two extension members.

In the illustrated embodiment, slots 130*a* and 130*b*, hard stop 112, and handle 118 are longitudinally spaced apart from one another a generally equal distance $d_i$. The distance $d_i$ is large enough to allow a weight plate 116 to be positioned on housing 128 between any two of these components. For instance, the distance $d_i$ between hard stop 112 and a first slot 130*a* is sufficiently large to allow for weight plate 116 to be positioned on housing 128 therebetween, as shown in FIGS. 2A-2C. Likewise, the distance $d_i$ between the first slot 130*a* and a second slot 130*b* is large enough to allow for a weight plate 116 to be positioned on housing 128 between slots 130*a-b*. The distance $d_i$ between the second slot 130*b* and handle 118 is also large enough to allow for a weight plate 116 to be positioned on housing 128 between the second slot 130*b* and handle 118.

With weight lock 114 in the unlocked position shown in FIG. 2A, one or more weight plates 116 can be positioned on first weight plate mount 104 without obstruction. That is, when weight lock 114 is in the unlocked position, extension members 132 do not extend out of slots 130, thereby allowing weight plates 116 to be freely slid on and off first weight plate mount 104. Each weight plate 116 can be positioned on first weight plate mount 104 by aligning handle 118 of weight lock 114 with an aperture 140 in weight plate 116 and sliding weight plate 116 onto first weight plate mount 104 so that handle 118 and housing 128 are inserted through aperture 140.

Once the desired weight plates 116 have been positioned on first weight plate mount 104, weight plates 116 can be selectively secured in place on first weight plate mount 104 by rotating weight lock 114. Handle 118 is configured to allow a user to rotate weight lock 114 in a direction that is generally about the axis of bar 102 and/or that is generally parallel to the circumference of exercise weight bar 102. In the illustrated embodiment, handle 118 is positioned outside of housing 128 to enable a user to readily grip handle 118. Nevertheless, handle 118 can also be positioned partially or entirely within housing 128. In any case, handle 118 can be rotated from the position shown in FIG. 2A to the positions shown in FIGS. 2B and 2C.

FIG. 2B shows first weight plate mount 104 with weight lock 114 having been rotated in the direction of arrow 142 to an intermediate position. In the illustrated intermediate position, weight lock 114 is neither fully in the unlocked position nor fully in the locked position. In the illustrated intermediate position, extension members 132 extend partially, but not fully, through slots 130. As shown, slots 130 are sized and configured to allow extension member 132 to freely rotate between an unlocked position and a locked position.

Continued rotation of weight lock 114, via handle 118, in the direction of arrow 142 will cause weight lock 114 to rotate to the locked position illustrated in FIG. 2C. In the locked position, extension members 132 extend fully from slots 130 to secure or retain weight plates 116 in place on first weight plate mount 104. For instance, with weight plate 116 positioned on first weight plate mount 104 as shown in FIG. 2C, weight plate 116 is positioned between hard stop 112 and slot 130*a*. With weight lock 114 in the locked position, weight plate 116 is securely held in place on first weight plate mount 104 between hard stop 112 and extension member 132*a*. More specifically, as positioned on first weight plate mount 104, weight plate 116 is positioned against hard stop 112, which prevents weight plate 116 from sliding onto handle 108 of exercise weight bar 102. Weight plate 116 is also prevented from sliding off of first weight plate mount 104 by extension member 132*a*, which is fully extended from slot 130*a* in FIG. 2C. In other words, extension member 132*a* extends out of slot 130*a* far enough to engage an inner face 144 of weight plate 116, thereby preventing weight plate 116 from sliding along first weight plate mount 104 toward handle 118. As shown in FIG. 2C, weight plate 116 is thus effectively held in position by hard stop 112 and extension member 132*a*.

As mentioned above, first weight plate mount 104 can be adapted to securely hold one or more weight plates 116 thereon. A weight plate 116 can be held on first weight plate mount 104 between hard stop 112 and extension member

132*a*, as discussed above. Similarly, a weight plate 116 can also be held on first weight plate mount 104 between extension members 132*a* and 132*b*. In addition, handle 118 can be formed with one or more handle extensions 146 that act to hold weight plates 116 in position like extension members 132. For example, a weight plate 116 may be placed on first weight plate mount 104 between extension member 132*b* and handle extension 146. When weight lock 114 is in the locked position, a weight plate 116 so positioned would be prevented from moving along first weight plate mount 104 toward handle 108 by extension member 132*b*. Thus, extension members 132 can limit or prevent weight plates 116 from moving along first weight plate mount 104 in either longitudinal direction. Additionally, a weight plate 116 positioned between extension member 132*b* and handle 118 would also be prevented from sliding off of first weight plate mount 104 by handle extension 146. That is, when weight lock 114 is in the locked position, handle extension 146 extends out past the cross-sectional profile of housing 128 to engage inner face 144 of weight plate 116, thereby preventing weight plate 116 from sliding off or being unintentionally removed from first weight plate mount 104.

As shown by arrows 142 and 148 in FIG. 2B, weight lock 116 can be rotated either clockwise or counter-clockwise. In the illustrated embodiment, rotation of weight lock 114 in the counter-clockwise direction of arrow 142 transitions weight lock 114 from the unlocked position shown in FIG. 2A to the locked position shown in FIG. 2C. In contrast, rotation of weight lock 114 in the clockwise direction of arrow 148 transitions weight lock 114 from the locked position shown in FIG. 2C to the unlocked position shown in FIG. 2A. In some embodiments, weight lock 114 can be rotated in the direction of arrow 142 to first transition from the unlocked position to the locked position and then, with continued rotation in the direction of arrow 142, to transition between the locked position to the unlocked position. Likewise, weight lock 114 could also be rotated in the direction of arrow 148 to alternatively transition between the unlocked and locked positions. Thus, weight lock 114 can be configured to rotate in a single direction or in multiple directions to alternatively and selectively transition between unlocked and locked positions.

The embodiment shown in FIGS. 1A-2C illustrates first and second weight plate mounts 104 and 106 as having generally triangular cross-sectional shapes or profiles. Handle extensions 150 are formed on handle 126 and are similar or identical to handle extensions 146. Housings 128 and 134 have slots 130 and 136, respectively, formed in each of the three primary faces of the triangularly shaped housings 128 and 134. Weight locks 114, 122, parts of which rotate within respective housings 128, 134, each include extension members and handle extensions 146, 150 extending in three general directions such that when weight locks 114 and 122 are in the locked positions, the extension members and handle extensions extend out past the cross-sectional profiles of housings 128 and 134, respectively. FIGS. 1B-2C show extension members 132, 138 extending in one of the three directions. When so extended, extension members 132, 138, handle extensions 146, 150, and the other extension members can engage and secure weight plates 116 and 124 on first and second weight plate mounts 104 and 106, respectively. Thus, in the locked configuration of FIG. 2C, weight plates 116 and 124 are maintained on all three sides of first and second weight plate mounts 104 and 106, respectively, by these sets of extension members and/or handle extensions.

In one embodiment, weight plate mount 106 has the same relationships and configurations as those described above with respect to weight plate mount 104. For instance, weight plate mount 106 includes a hard stop 120, a housing 134, and a weight lock 122 that are similar or identical to hard stop 112, housing 128, and weight lock 114 of weight plate mount 104.

In some embodiments, the first and second weight plate mounts have cross-sectional shapes or profiles that are not triangular. For instance, circular, oval, elliptical, rectangular, or square profiles could also be employed. In such cases, extension members and handle extensions could be arranged to extend in a variety of directions so that they extend out past the selected profile of the first and second weight plate mounts. Thus, one of skill in the art will readily recognize that first and second weight plate mounts, weight locks, handle extensions, and extension members may be any of a variety of sizes and shapes. Additionally, in some embodiments, a weight plate mount of an exercise weight bar is a different shape than the shape of a weight lock, handle extensions, and/or extension members.

Figure 3:
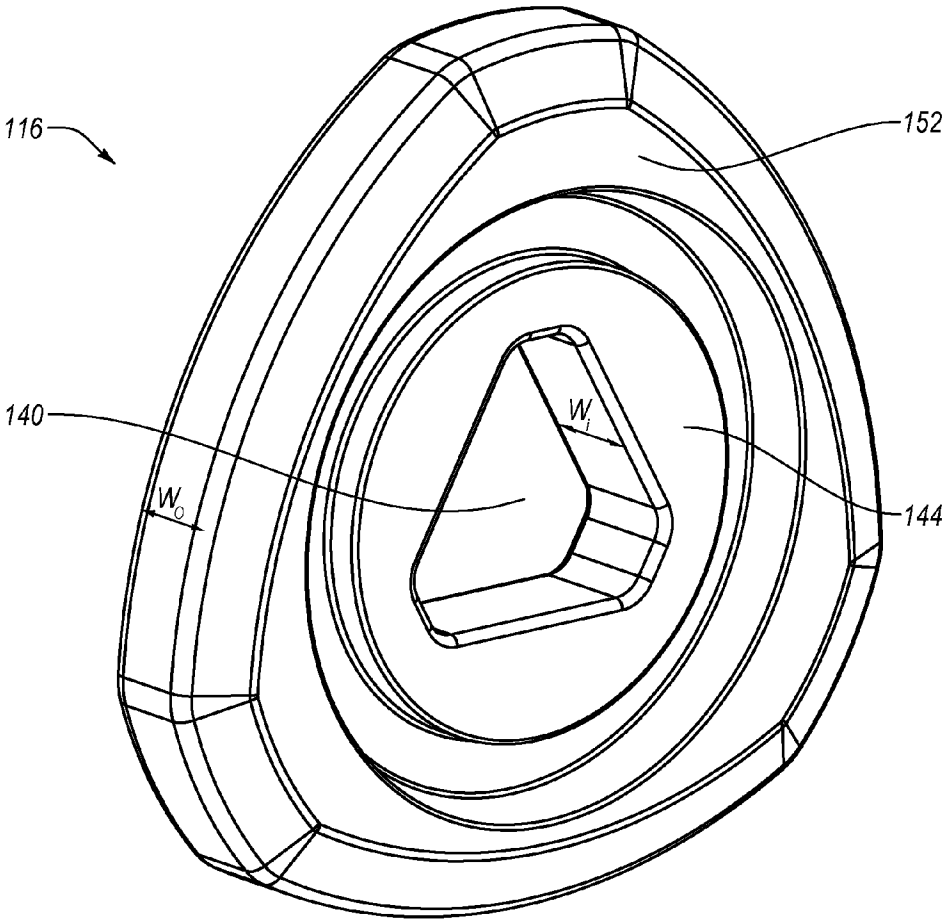
FIG. 3 illustrates one exemplary embodiment of a weight plate for use with an exercise weight bar of the present invention.

Turning now to FIG. 3, one exemplary embodiment of a weight plate for use with the exercise weight bars of the present invention will now be described. FIG. 3 shows weight plate 116 from FIGS. 1A-2C. Weight plate 116 is similar or identical to weight plates 124 shown in FIG. 1A. Thus, the following description of weight plate 116 will be applicable to weight plates 124. In describing weight plate 116, reference will be made to certain components of first weight plate mount 104, including housing 128, hard stop 112, slots 130, weight lock 114, extension members 132, handle 118, and handle extensions 146. Nevertheless, it will be understood that the following description is equally applicable to second weight plate mount 106 and its components. Additionally, while weight plate 116 will be described in some detail below, it will be appreciated that weight plates having different configurations can be used in connection with the exercise weight bars of the present invention so long as the weight plates can be engaged by a hard stop, one or more extension members, and/or a handle extension to securely and selectively hold the weight plate on the exercise weight bar.

Weight plate 116 includes opposing inner faces 144 (only one shown) defining an aperture 140 therethrough. As discussed above, aperture 140 is configured to receive handle 118 and housing 128 therethrough to allow weight plate 116 to be positioned on first weight plate mount 104. Opposing inner faces 144 are spaced apart from one another by a distance such that weight plate 116 has an inner width $w_i$. Inner width $w_i$ is generally equal to or less than distance $d_i$ that separates hard stop 112, slots 130, and handle 118. Making inner width $w_i$ equal to or less than distance $d_i$ allows weight plate 116 to be positioned on first weight plate mount 104 so that opposing inner faces 144 are positioned between either hard stop 112 and slot 130*a*, between slot 130*a* and slot 130*b*, or between slot 130*b* and handle extensions 146 to selectively secure weight plate 116 on first weight plate mount 104.

In the illustrated embodiment of weight plate 116, aperture 140 is generally triangularly shaped so as to generally conform to the cross-sectional profile or shape of housing 128. Sizing and shaping aperture 140 to generally conform to the size and shape of housing 128 allows weight plate 116 to be positioned and held on first weight plate mount 104 in a stable manner. Nevertheless, one of skill in the art will recognize other configurations and forms of weight plates in accordance with the present invention. For example, an aperture of weight plate usable with the exercise weight bars of the present invention may have other shapes. Further, the shape of the weight plate and aperture may be the same or they may be different from one another or from housing 128.

Weight plate 116 also has opposing outer faces 152 (only one shown) that are spaced apart from one another by a distance such that weight plate 116 has an outer width $w_o$. In the illustrated embodiment, outer width $w_o$ is greater than inner width $w_i$. For instance, outer width $w_o$ can be equal to the distance from hard stop 112 to the center of extension member 132*a*, the distance between the center of extension member 132*a* and the center of extension member 132*b*, or the distance between the center of extension member 132*b* and handle extension 146. When outer width $w_o$ is so sized and two weight plates 116 are mounted next to one another on first weight plate mount 104, an outer surface 152 from each weight plate 116 may interface or contact one another. Securing adjacent weight plates 116 on first weight plate mount 104 with outer surfaces 152 in contact provides additional stability to weight plates 116 on first weight plate mount 104.

Making inner width $w_i$ smaller than outer width $w_o$ allows for outer surfaces 152 of adjacent weight plates 116 to contact one another while still providing space between inner surfaces 144 of the adjacent weight plates 116. The space between inner surfaces 144 of adjacent weight plates 116 allows for extension members 132 to extend out of slots 130 between the adjacent inner surfaces 144 of adjacent weight plates 116. With extension members 132 positioned between adjacent inner surfaces 144, extension members 132 can engage inner surfaces 144 and limit or prevent weight plates 116 from moving along the length of first weight plate mount 104.

Figure 4:
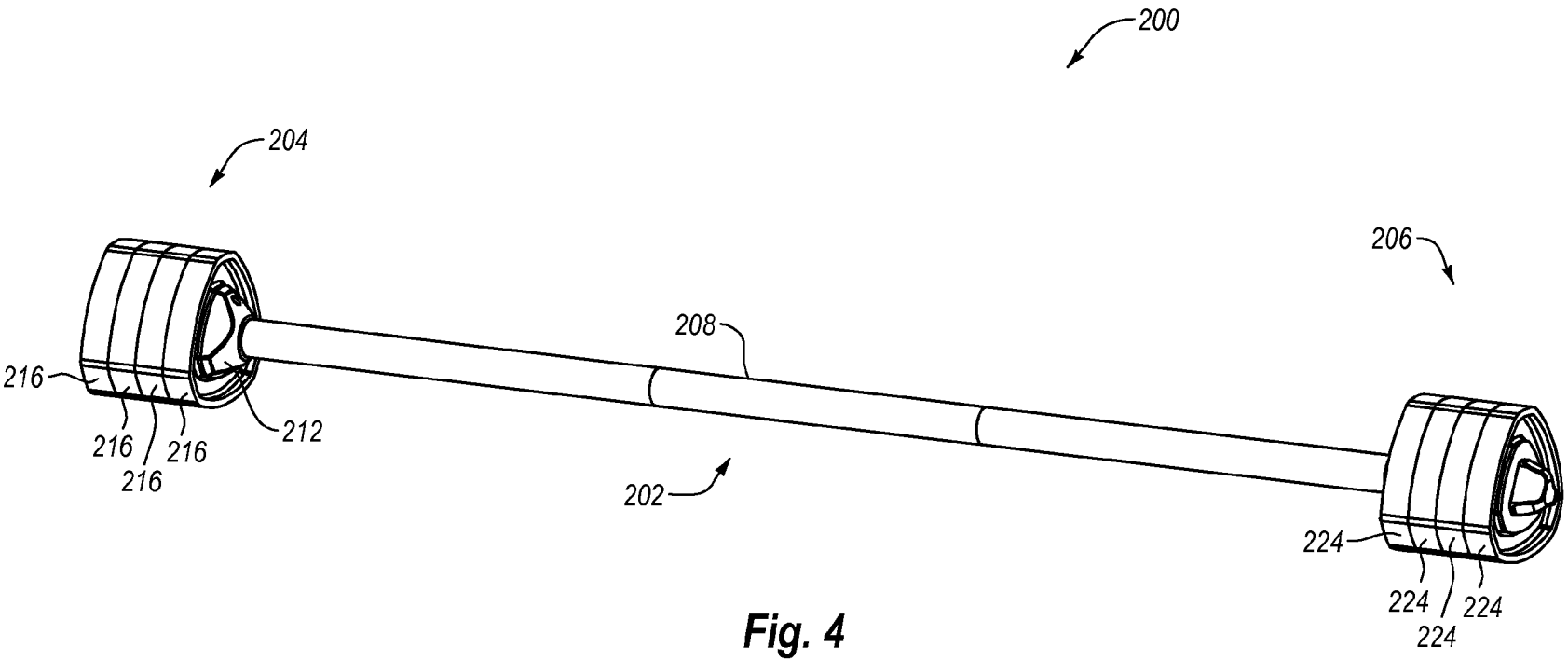
FIG. 4 illustrates another exemplary embodiment of an exercise weight bar assembly according to the present invention and which is configured for two-handed exercises.
Figure 5:
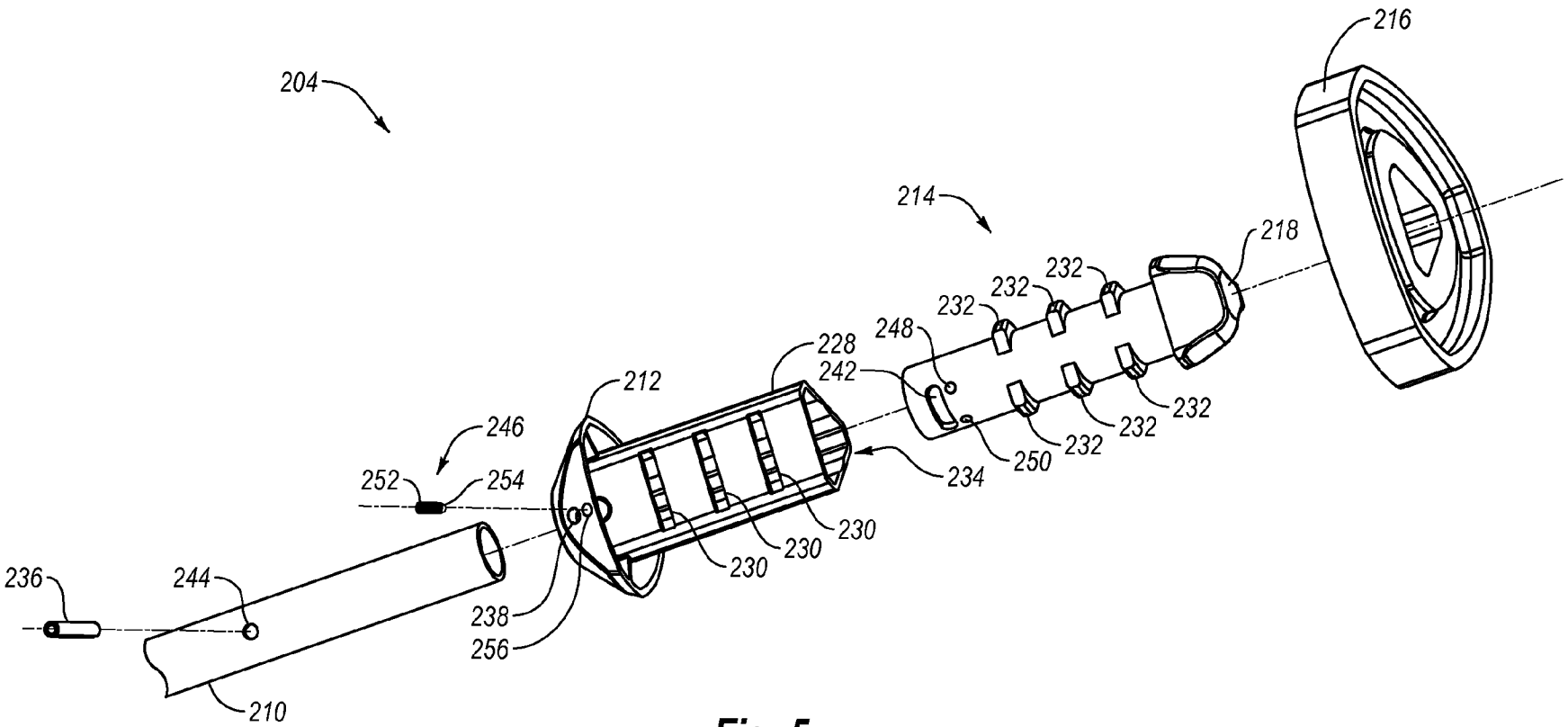
FIG. 5 illustrates an exploded view of an end of an exercise weight bar from the exercise weight bar assembly shown in FIG. 4.

With reference to FIGS. 4 and 5, another exemplary embodiment of an exercise weight bar assembly according to the present invention is illustrated. FIG. 4 illustrates an exercise weight bar assembly 200. Exercise weight bar assembly 200 is similar to exercise weight bar assembly 100 in many respects. For instance, exercise weight bar assembly 200 includes an exercise weight bar 202 having a first weight plate mount 204, a second weight plate mount 206, and a gripping portion 208 therebetween. Gripping portion 208 can include a texture or a non-slip surface or material to provide for improved gripping during exercise. Gripping portion 208 of exercise weight bar 202 is sized to allow a user to grip exercise weight bar 202 with both hands if desired. Such an embodiment is useful for the performance of weight-based exercises requiring the use of both hands, such as bench-press exercises.

Also like exercise weight bar 102, first and second weight plate mounts 204, 206 of exercise weight bar 202 can include components similar or identical to respective first and second weight plate mounts 104, 106 for selectively securing weight plates 216, 224 thereto. FIG. 5 illustrates an exploded view of first weight plate mount 204, including the components of first weight plate mount 204. As seen in FIG. 5, the components of first weight plate mount 204 are similar or identical to the components of first weight plate mount 104. For instance, first weight plate mount 204 includes a hard stop 212, a housing 228 with slots 230 formed therein, and a weight lock 214 with extension members 232 thereon. In the illustrated embodiment, hard stop 212 is integrally formed with housing 228. However, hard stop 212 and housing 228 could also be formed separately and later joined, coupled, or linked together.

As seen in FIG. 5, housing 228 has a hollow interior portion 234 that is adapted to receive a portion of a rod 210 and a portion of weight lock 214 therein. Weight lock 214 can also include a hollow portion that can receive part of rod 210 therein. Thus, weight lock 214 can be partially inserted into hollow interior portion 234 of housing 228 and a portion of rod 210 can be inserted into both hollow interior portion 234 of housing 228 and into the hollow portion of weight lock 214.

Rod 210 can serve as a handle and can include gripping portion 208, which may include a comfortable grip, for example. First and second weight plate mounts 204, 206 are linked to rod 210. Thus a handle (in the form of rod 210), first weight plate mount 204, and second weight plate mount 206 are linked to one another. In another embodiment, a handle, a first weight plate mount, and a second weight plate mount can be linked by being directly coupled to one another by way of adhesives, molding, fusing, welding, bonding, mechanical fasteners, or other coupling mechanisms. Thus, in one embodiment, a handle of the present invention comprises a rod to which the weight plate mounts are linked, as illustrated in an exploded view in FIG. 5. The rod may have a comfortable grip mounted thereon for convenient handling. The rod may have multiple sections, or may be selectively extendible for convenient adjustment according to the size and desired grasping position of a user. In yet another embodiment, a handle of the present invention comprises a grip, e.g., a solid grip, to which the weight plate mounts are directly linked on opposing ends of the grip.

Once housing 228 and weight lock 214 are assembled on rod 210 as described above, rod 210, housing 228, and weight lock 214 can be secured together. In the illustrated embodiment, for instance, cross pin 236 can be inserted into opening 238 in hard stop 212, through rotation slot 242 in weight lock 214, and into opening 244 in rod 210. In other embodiments, rod 122, housing 228, and weight lock 214 can be secured together in other ways, including with screws, pins, clips, friction fittings, and the like.

Notably, rotation slot 242 in weight lock 214 extends around a portion of the circumference of weight lock 214. This configuration of rotation slot 242 allows for weight lock 214 to rotate within housing 228 and about an axis that is collinear or generally parallel to a longitudinal axis of exercise weight bar 202 while cross pin 236 limits or prevents weight lock 214 from moving along the longitudinal axis of exercise weight bar 202. Thus, this configuration allows for weight lock 214 to rotate between a locked position and an unlocked position, as described in additional detail with respect to weight lock 114 described above. In particular, cross pin 236 and rotation slot 242 cooperate to allow weight lock 214 to rotate so that extension members 232 either extend out of slots 230 or are retracted within slots 230 to secure or release a weight plate 216 from first weight plate mount 204.

The illustrated embodiment of weight plate mount 204 also includes a position holder mechanism that selectively secures weight lock 214 in a locked or unlocked position so that weight lock 214 does not freely rotate during use of exercise weight bar assembly 200. In the illustrated embodiment, the position holder mechanism includes a spring loaded ball screw 246 having a spring loaded ball 254 therein that engages recesses or apertures 248, 250 in weight lock 214. More specifically, spring loaded ball screw 246 includes a shaft 252 with a spring positioned therein. The spring biases ball 254 out one end of shaft 252. Shaft 252 can be inserted into an opening 256 in hard stop 212 so that ball 254 extends at least partially into hollow interior portion 234 of housing 228. Shaft 252 can include threads that mate with threads in opening 256 to hold shaft 252 within opening 256. Alternatively, shaft 252 can be held in opening 256 in other ways, including with adhesives, pins, clamps, or friction fittings.

With shaft 252 positioned within opening 256, ball 254 extends into hollow interior portion 234 of housing 228 and engages weight lock 214. Specifically, when weight lock 214 is in an unlocked position, ball 254 engages recess 248 to hold weight lock 214 in the unlocked position. In contrast, when weight lock 214 is in a locked position, ball 254 engages recess 250 to hold weight lock 214 in the locked position. The spring within shaft 252 may have a spring coefficient that provides a force sufficient to push ball 254 into recess 248 or recess 250 to prevent weight lock 214 from freely rotating. The spring coefficient of the spring within shaft 252 is low enough to allow a user to overcome the force applied to ball 254, thereby allowing ball 254 to be withdrawn from recess 248 or recess 250. For instance, when rotating weight lock 214 using handle 218, a user can overcome the force of the spring, thereby allowing ball 254 to withdraw from recess 248. As ball 254 is withdrawn from recess 248, weight lock 214 can be rotated until ball 254 engages recess 250.

The illustrated and described position holder mechanism is but one example of a mechanism for holding weight lock 214 in a desired position. For instance, a position holder mechanism may include recesses 248 and 250 as shown in FIG. 5 as well as a protrusion or bump formed on the inside of hard stop 212 or housing 228 that engages recesses 248, 250 is a similar manner as ball 254 described above. In another embodiment, a position holder mechanism may include a leaf spring that engages one or more notches or other indentations on a rod of exercise weight bar 202 when weight lock 214 is in a locked and/or an unlocked position. The leaf spring may have a spring coefficient that provides a force such that weight lock 214 may not freely rotate without the exertion of rotational force by a user on handle 218. One of skill in the art will recognize many other configurations and mechanisms that may be used as position holders so that weight lock 214 may be secured in a locked and/or in an unlocked position. The position holder mechanism described in connection with FIG. 5 may also be used in the weight plate mounts of FIGS. 1A-2C, for example.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

INDUSTRIAL APPLICABILITY

The exercise weight bars of the present invention are intended to provide a quick, efficient, and reliable way for securing weight plates to an exercise weight bar. In particular, the weight locks described above allow for one or more weight plates to be positioned on the exercise weight bar without any obstruction from the weight locks. Once the desired weight plates are positioned on the exercise weight bar, the weight locks can be easily rotated so that extension members engage the weight plates to securely hold the weight plates on the exercise weight bar during exercise. Once exercise is complete or if a user desires to remove some or all of the weight plates from the exercise weight bar, the weight locks can be easily rotated to disengage the weight plates, thereby allowing the user to slide the weight plates off of the exercise weight bar. The weight locks of the present invention can remain attached to or part of the exercise weight bars so that they are not misplaced. Thus, the present invention provides a quick, reliable mechanism for selectively securing weight plates to an exercise weight bar that will not be separated from the exercise weight bar or misplaced.

What is claimed is:

1. An exercise weight bar adapted to have weight plates selectively secured thereto for exercise, the exercise weight bar comprising:

a handle having a first end and a second end; and a first weight plate mount linked to the first end of the handle and a second weight plate mount linked to the second end of the handle, wherein each of the first and second weight plate mounts has at least one slot formed therein, each of the first and second weight plate mounts comprising:

a rotatable weight lock having at least one extension member that corresponds with the at least one slot, wherein the rotatable weight lock is rotatable about a first axis that is generally parallel to a longitudinal axis of the exercise weight bar between a locked position and an unlocked position, wherein the at least one extension member extends through the at least one slot when the rotatable weight lock is in the locked position, and wherein the at least one extension member does not extend through the at least one slot when the rotatable weight lock is in the unlocked position; and a weight lock handle that rotates about the first axis, wherein rotation of the weight lock handle about the first axis causes the rotatable weight lock to rotate about the first axis, the weight lock handle having one or more handle extensions that rotate between the locked and unlocked positions, wherein the one or more handle extensions engage and secure a weight plate on the weight plate mount when the one or more handle extensions are in the locked position.

2. The exercise weight bar recited in claim 1, wherein the first weight plate mount has a generally triangular configuration.

3. The exercise weight bar recited in claim 1, wherein the one or more handle extensions disengage a weight plate on the weight plate mount when the one or more handle extensions are rotated to the unlocked position, thereby enabling the weight plate to be selectively removed from the weight plate mount.

4. The exercise weight bar recited in claim 1, wherein each of the first and second weight plate mounts comprises a hard stop that prevents the weight plates from sliding onto the handle.

5. The exercise weight bar recited in claim 1, wherein each of the first and second weight plate mounts comprises a housing.

6. The exercise weight bar recited in claim 5, wherein the at least one slot is formed in the housing.

7. The exercise weight bar recited in claim 6, wherein the rotatable weight lock is at least partially positioned within the housing.

8. The exercise weight bar recited in claim 7, wherein rotation of the rotatable weight lock between the unlocked and locked positions enables the at least one extension member to extend out of the housing through the at least one slot or be refracted within the housing through the at least one slot.

9. An exercise weight bar configured to have weight plates quickly and efficiently secured thereto, the exercise weight bar comprising:

a handle having a first end and a second end;

a housing linked to the first end of the handle, the housing having a first end, a second end positioned further away from the handle than the first end, and a plurality of slots positioned between the first and second ends of the housing, wherein the housing is adapted to have one or more weight plates positioned thereon;

a hard stop disposed at the first end of the housing to prevent the weight plates from moving onto the handle; and a rotatable weight lock positioned at least partially within the housing, the rotatable weight lock being rotatable about an axis that is generally parallel to a longitudinal axis of the exercise weight bar between a locked position and an unlocked position to selectively engage or disengage weight plates positioned on the housing, the rotatable weight lock comprising:

a plurality of extension members that extend through the plurality of slots of the housing to selectively engage the weight plates when the rotatable weight lock is rotated to the locked position, and wherein the plurality of extension members is retracted through the plurality of slots into the housing so as to disengage the weight plates when the rotatable weight lock is rotated to the unlocked position; and a weight lock handle disposed at the second end of the housing, the weight lock handle facilitating rotation of the rotatable weight lock between the unlocked and locked positions, the weight lock handle comprising one or more handle extensions, wherein the one or more handle extensions extend beyond a cross-sectional profile of the housing to engage and secure a weight plate on the housing when the rotatable weight lock is in the locked position, and wherein the one or more handle extensions do not extend beyond the cross-sectional profile of the housing when the rotatable weight lock is in the unlocked position, thereby enabling one or more weight plates to be selectively positioned on or removed from the housing.

10. The exercise weight bar recited in claim 9, further comprising a housing, a hard stop, and a weight lock disposed at the second end of the handle.

11. The exercise weight bar recited in claim 9, wherein the housing has a cross-sectional shape that generally corresponds to the cross-sectional shape of an aperture in a weight plate that is received on the housing.

12. The exercise weight bar recited in claim 9, wherein the plurality of slots includes two or more slots that are longitudinally spaced apart between the first and second ends of the housing.

13. The exercise weight bar recited in claim 12, wherein the plurality of extension members includes two or more longitudinally spaced apart extension members, wherein the two or more longitudinally spaced apart extension members correspond to the two or more slots such that the two or more longitudinally spaced apart extension members extend out of the two or more slots when the rotatable weight lock is rotated to the locked position.

14. The exercise weight bar recited in claim 9, wherein the plurality of slots extend generally parallel to the circumference of the bar.

15. The exercise weight bar recited in claim 9, wherein the plurality of extension members is extended and retracted through the plurality of slots of the housing by rotating the plurality of extension members generally about an axis that is generally parallel to the longitudinal axis of the exercise weight bar.

16. A weightlifting device, comprising:

a handle having a first end and a second end;

a plurality of weight plates that correspond to the first end and a plurality of weight plates that correspond to the second end; and a first latching mechanism associated with the first end and a second latching mechanism associated with the second end, wherein each of the first and second latching mechanisms comprises:

a wall at least partially defining a hollow interior portion, the wall having a cross-sectional profile and being configured to receive one or more of the plurality of weight plates;

a plurality of slots formed within the wall;

a rotatable locking mechanism that rotates within the hollow interior portion and about an axis that is generally parallel to a longitudinal axis of the weightlifting device, the rotatable locking mechanism having a locked position and an unlocked position, wherein a portion of the rotatable locking mechanism extends through the plurality of slots and engages one or more of the plurality of weight plates when in the locked position, wherein a portion of the rotatable locking mechanism does not extend through the plurality of slots when in the unlocked position; and a latching mechanism handle that facilitates rotation of the rotatable locking mechanism between the unlocked and locked positions, the latching mechanism handle comprising one or more handle extensions, wherein the one or more handle extensions extend beyond the cross-sectional profile of the wall to engage and secure a weight plate on the wall when the rotatable locking mechanism is in the locked position, and wherein the one or more handle extensions do not extend beyond the cross-sectional profile of the wall when the rotatable locking mechanism is in the unlocked position, thereby enabling one or more weight plates to be selectively positioned on or removed from the wall.

17. The weightlifting device recited in claim 16, wherein the wall has a generally triangular cross-sectional profile.

18. The weightlifting device recited in claim 16, wherein the plurality of slots are longitudinally spaced apart along the length of the wall such that a weight plate of the plurality of weight plates can be positioned between the plurality of slots.

19. The weightlifting device recited in claim 16, wherein each weight plate of the pluralities of weight plates includes opposing inner faces, an aperture formed through opposing inner faces, and opposing outer faces.

20. The weightlifting device recited in claim 19, wherein the opposing inner faces are spaced apart from one another by a first distance, and wherein the opposing outer faces are space apart from one another by a second distance that is greater than the first distance.

* * * * *